US011198492B2

(12) United States Patent
Cappiello

(10) Patent No.: US 11,198,492 B2
(45) Date of Patent: Dec. 14, 2021

(54) STABILIZATION SYSTEM FOR A WATERCRAFT

(71) Applicant: CMC Marine S.r.l., Milan (IT)

(72) Inventor: Alessandro Cappiello, Milan (IT)

(73) Assignee: CMC Marine S.r.l., Milan (IT)

( * ) Notice: Subject to any disclaimer, the term of this patent is extended or adjusted under 35 U.S.C. 154(b) by 49 days.

(21) Appl. No.: 16/633,410

(22) PCT Filed: Jul. 11, 2018

(86) PCT No.: PCT/IB2018/055122

§ 371 (c)(1),
(2) Date: Jan. 23, 2020

(87) PCT Pub. No.: WO2019/021094

PCT Pub. Date: Jan. 31, 2019

(65) Prior Publication Data

US 2020/0377182 A1 Dec. 3, 2020

(30) Foreign Application Priority Data

Jul. 24, 2017 (IT) ..... 102017000084215
Jul. 24, 2017 (IT) ..... 102017000084238
Jul. 24, 2017 (IT) ..... 102017000084257

(51) Int. Cl.
*B63B 39/06* (2006.01)

(52) U.S. Cl.
CPC ..... *B63B 39/06* (2013.01); *B63B 2039/067* (2013.01)

(58) Field of Classification Search
CPC ..... B63B 39/06; B63B 2039/065; B63B 2039/067; B63B 79/00; B63B 79/10; B63B 79/15
See application file for complete search history.

(56) References Cited

U.S. PATENT DOCUMENTS 2,257,559 A 9/1941 Albertson
2,893,340 A * 7/1959 Du Cane ..... B63B 39/06 114/126

(Continued)

FOREIGN PATENT DOCUMENTS

EP 0 388 207 9/1990
EP 2 452 870 5/2012

(Continued)

OTHER PUBLICATIONS

International Search Report and Written Opinion of the ISA for PCT/IB2018/055122, dated Sep. 28, 2018, 20 pages.

*Primary Examiner* — Ajay Vasudeva
(74) *Attorney, Agent, or Firm* — Nixon & Vanderhye P.C.

(57) ABSTRACT

Described herein is a system for stabilising a watercraft with a hull. The stabilising system comprises a stabilising fin fixed with respect to a shaft of the fin, a driving system comprising an electric motor with hollow shaft and a reduction gear with hollow shaft for turning the shaft of the fin, and a control system configured for receiving identification data on the roll of the watercraft and for driving the electric motor as a function of the roll. In particular, the casing of the driving system comprises a toroidal portion configured for being inserted in an opening of the hull, wherein the toroidal portion comprises features for fixing the casing to the hull. The reduction gear comprises an output connected to the shaft of the fin and an input. The electric motor is arranged in the toroidal portion and comprises a stator fixed with respect to the casing and a rotor connected to the input of the reduction gear, wherein the shaft of the fin passes through the electric motor and the reduction gear, and the electric motor is arranged between the reduction gear and the stabilising fin.

26 Claims, 8 Drawing Sheets

(56) References Cited

U.S. PATENT DOCUMENTS

| | | | | |
|---|---|---|---|---|
| 3,020,869 | A | 2/1962 | Beach | |
| 4,023,516 | A * | 5/1977 | Bennett | B63B 39/06 114/126 |
| 5,394,769 | A | 3/1995 | Cropley | |
| 10,246,170 | B2 * | 4/2019 | Venables | B63B 39/06 |
| 10,322,778 | B2 * | 6/2019 | Widmark | B63B 43/04 |
| 2007/0181357 | A1 | 8/2007 | Saito et al. | |
| 2019/0031313 | A1 * | 1/2019 | Trivelli | F16H 1/32 |

FOREIGN PATENT DOCUMENTS

| | | |
|---|---|---|
| JP | 2002-372110 | 12/2002 |
| WO | 2013/004678 | 1/2013 |
| WO | 2016/188963 | 12/2016 |
| WO | 2017/130100 | 8/2017 |

* cited by examiner

STABILIZATION SYSTEM FOR A WATERCRAFT

This application is the U.S. national phase of International Application No. PCT/M2018/055122 filed 11 Jul. 2018, which designated the U.S. and claims priority to IT Patent Application No. 102017000084215 filed 24 Jul. 2017, IT Patent Application No. 102017000084238 filed 24 Jul. 2017, and IT Patent Application No. 102017000084257 filed 24 Jul. 2017, the entire contents of each of which are hereby incorporated by reference.

FIELD OF THE INVENTION

The present disclosure relates to a system for stabilising a watercraft.

DESCRIPTION OF THE PRIOR ART

One of the major causes of malaise on board a watercraft, both during navigation and at anchor, is the roll to which it is subject on account of wave motion.

For this reason, stabilising systems are frequently used, which comprise one or more stabilising fins.

For instance, FIG. 1 shows an example of the hull 15 of a watercraft, wherein a plurality of stabilising fins 16 are mounted on said hull 15. The purpose of the stabilising fins 16 is to increase the on-board comfort by considerably reducing the motions of roll in all the conditions of use of the watercraft, both during navigation and at anchor. In particular, the term "stabilising fin" of a watercraft or ship typically indicates a substantially laminar plane structure, associated to the bottom part of the hull 15 of the watercraft and mounted in an oscillating way on a dedicated shaft for being generally appropriately driven or oriented by actuator assemblies or assemblies C of a hydraulic and electromechanical type for stabilising navigation of the watercraft itself and, prevalently, roll when the watercraft is anchored.

For instance, through rotation of one or more pairs of fins 16, symmetrical with respect to the longitudinal axis of the hull 15, it is possible to create a momentum on the watercraft that can be exploited for countering the momentum generated by the wave motion and thus markedly reduce roll.

In particular, during navigation the stabilising fins 16 exploit the phenomenon of the lift to generate high stabilising momenta with a relatively exiguous actuation surface. For instance, the documents Nos. GB 999 306, EP 0 754 618 and GB 1 201 401 describe systems for anti-roll stabilisation of watercraft during navigation.

Instead, at anchor it is not possible to exploit the lift but it is necessary to exploit the inertial forces (acceleration and deceleration) and the forces of viscous resistance (linked to the velocity of actuation of the fin 16) to generate the stabilising momentum. Is may be easily understood that for stabilisation at anchor it is useful to have an actuation surface markedly greater than the one sufficient during navigation and that the aspect ratio of the fin has a major influence on efficiency. For instance, the document No. EP 1 577 210 describes a system of the above sort for anti-roll stabilisation of watercraft stationary at anchor in which the aspect ratio of the fin can be modified.

In both cases hence is used a control unit configured for detecting, by means of appropriate sensors, such as gyroscopes or accelerometers, data indicative of the oscillation of the watercraft and for driving the electromechanical control assembly C as a function of the data detected in such a way as to reduce the aforesaid oscillation.

FIG. 2 illustrates in this context a generic control scheme, in which a control system CS controls operation of a system under control IMP. In particular, the control system CS comprises a control module CU configured for generating a control signal u necessary for minimising and/or cancelling out an error e. For instance, the error e may be determined in a block ERR as difference between a reference signal r and a measurement signal y that indicates the state of the system IMP.

In particular, in the case of the stabilising fins, the system IMP comprises both the watercraft 15 and the stabilising system, which in turn comprises the actuation system C and a fin 16. Consequently, the control system CS has the purpose of countering roll; i.e., the reference signal r is typically zero, the measurement signal y corresponds to a signal that represents the roll of the watercraft a, and the control signal u represents the signal that drives the actuator C of the fin 16.

To carry out for its own stabilising function in a satisfactory way, the aforementioned fin 16 hence calls for high torques generated by a corresponding electromechanical assembly C connected to a shaft of the fin 16.

For instance, the document No. EP 2 172 394 describes a system for anti-roll stabilisation of watercraft in which an electric motor and an epicyclic reduction gear are used as actuator C for the stabilising fin 16.

Instead, the Italian patent application No. 102016000007060 describes an electromechanical assembly C in which a reduction gear is mounted coaxially and above an electric motor with respect to the stabilising fin 16 in such a way that the electric motor can be cooled via the water on which the watercraft floats.

OBJECT AND SUMMARY

The object of the present description is to provide solutions that improve operation of known stabilising systems.

With a view to achieving the aforesaid object, various embodiments of the present description provide a stabilising system having the characteristics specified in the annexed claim 1.

The claims form an integral part of the teaching provided herein in relation to the invention.

As mentioned previously, the present disclosure provides solutions for anti-roll stabilisation of a watercraft.

In general, a system for stabilising a watercraft with a hull comprises a stabilising fin fixed with respect to a shaft of the fin, a driving system comprising an electric motor and a reduction gear for turning the shaft of the fin, and a control system configured for receiving data identifying the roll of the watercraft and for driving the electric motor as a function of the roll. As described previously, the stabilising system typically comprises a pair (or a number of pairs) of stabilising fins, wherein a driving system is associated to each fin. Instead, typically only a single control system is used for the fins of one pair (or possibly for all the fins).

In various embodiments, the driving system comprises a casing including a toroidal portion configured for being inserted in an opening in the hull of the watercraft, wherein the toroidal portion comprises means for fixing the casing to the hull.

In various embodiments, the reduction gear is a reduction gear with hollow shaft, wherein the reduction gear comprises an outer body, an output connected to the shaft of the fin, and an input. For instance, in various embodiments, the output of the reduction gear is connected to the shaft of the fin by means of a (first) flange, wherein the flange is fixed with respect to the output of the reduction gear, for example by means of screws, and wherein the flange is connected to the shaft of the fin, for example by means of a mechanical coupling.

In various embodiments, the electric motor is a motor with hollow shaft, wherein the electric motor is arranged in the toroidal portion and comprises a stator fixed with respect to the casing and a rotor connected to the input of the reduction gear, and wherein the shaft of the fin traverses the electric motor and the reduction gear, and the electric motor is arranged between the reduction gear and the stabilising fin. For instance, in various embodiments, the rotor is connected to the input of the reduction gear by means of a (second) flange with central opening and a hollow sun pinion, wherein the flange with central opening is fixed with respect to the rotor, for example by means of screws, and the hollow sun pinion is connected to the flange with central opening, and wherein the hollow sun pinion meshes/engages directly or indirectly by means of additional planetary gears with the input of the reduction gear.

According to a first aspect of the present description, the casing of the driving system comprises a motor flange removably fixed to the toroidal portion, wherein the stator is fixed, on a first side, to the motor flange, and the outer body of the reduction gear is fixed, on the opposite side, to the motor flange. Consequently, by disassembling the motor flange, the motor and the reduction gear can be removed, whereas the toroidal portion remains fixed to the hull, thus simplifying installation and maintenance of the driving system.

In this context, it is advantageously that the shaft of the fin is sealed towards the toroidal portion of the casing. For instance, in various embodiments, the casing comprises a cover removably fixed to the outer side of the toroidal portion facing the stabilising fin, wherein the cover comprises at least one gasket for sealing the opening between the toroidal portion and the shaft of the fin. In various embodiments, the cover is made of stainless steel, or a material resistant to water, in particular to sea water.

Moreover, in various embodiments, the shaft of the fin is supported by means of bearings in the toroidal portion. For instance, in various embodiments, a plurality of bearings is arranged radially with respect to the axis of the shaft of the fin between the toroidal portion and the shaft of the fin.

Consequently, when the motor flange (with motor and reduction gear) is removed, the toroidal portion (with shaft and gasket) remains fixed to the hull, also guaranteeing tightness.

In general, the casing of the driving system may also comprise further elements. For instance, the casing may comprise a tubular portion fixed to the motor flange, wherein the reduction gear is arranged within the tubular portion. The casing may also comprise a second cover fixed to the outer body of the reduction gear and/or the tubular portion in such a way as to cover the reduction gear.

The motor flange may also be used for other purposes. For instance, in various embodiments, a blocking system is fixed to the motor flange, wherein said blocking system is configured for selectively inhibiting rotation of the flange fixed to the rotor of the motor. The motor flange may also comprise an electrical connector for receiving the driving signals for the stator of the electric motor.

According to a second aspect of the present disclosure, the stabilising system comprises an absolute encoder, wherein the body of the absolute encoder is fixed with respect to the casing, and the input of the absolute encoder is coupled by transmission means to the flange that connects the output of the reduction gear to the shaft of the fin.

For instance, in various embodiments, the casing comprises a motor flange removably fixed to the toroidal portion, wherein the stator is fixed, on a first side, to the motor flange and the outer body of the reduction gear is fixed, on the opposite side, to the motor flange. Optionally, the casing may also comprise a tubular portion fixed to the motor flange, wherein the reduction gear is arranged within the tubular portion. In this case, the absolute encoder may be fixed with respect to the outer body of the reduction gear or the tubular portion.

In various embodiments, the transmission means comprise a first pulley fixed with respect to the input of the absolute encoder and a second pulley fixed with respect to the flange, wherein the first pulley is connected to the second pulley by means of a belt. Alternatively, a first gear may be fixed with respect to the input of the absolute encoder and a second gear may be fixed with respect to the flange.

The lateral arrangement of the absolute encoder hence enables reduction of the height of the driving system. Moreover, the driving system may comprise a visual indicator, for example in the form of a tab, which is fixed with respect to the flange, and a graduated scale, in such a way as to provide the angle of rotation of the flange and hence of the shaft of the fin.

In various embodiments, the flange connected to the output of the reduction gear may also be used for other purposes. For instance, in various embodiments, the flange has at least partially a shaped profile, wherein the driving system comprises a toothed pin, and wherein the driving system is configured in such a way that a rotation of the pin also turns the flange. In various embodiments, the casing may comprise for this purpose a seat in which the pin can be inserted.

In various embodiments, the system may also comprise an additional incremental encoder, wherein the body of the incremental encoder is fixed with respect to the casing, and wherein the incremental encoder is configured for detecting the velocity and/or acceleration of rotation of the flange connected to the rotor of the motor. For instance, in various embodiments, the incremental encoder is a magnetic encoder configured for detecting rotation of a magnetic ring fitted on the flange.

Consequently, the absolute encoder and the incremental encoder may be connected to the control system, wherein the control system is configured for driving the electric motor also as a function of the data supplied by the encoders.

According to a third aspect of the present disclosure, the driving system comprises a blocking system configured for selectively blocking rotation of the first flange connected to the output of the reduction gear or of the second flange connected to the rotor of the motor. For instance, in various embodiments, the first flange (between the output of the reduction gear and the shaft of the fin) or the second flange (between the rotor of the motor and the input of the reduction gear) is shaped so as to comprise a plurality of slots/cut-outs, or a further flange is fixed with respect to the first flange or the second flange, wherein the further flange is shaped so as to comprise a plurality of slots/cut-outs.

Consequently, the blocking system may comprise a pin that is able to move in such a way that in a first position, the pin is inserted in one of the slots and blocks rotation of the first flange or of the second flange, and in a second position, the pin is not inserted in any slot, and the first flange or the second flange can be turned.

Preferably, the blocking system is configured in such a way that the pin is movable in a radial direction with respect to the axis of the shaft of the fin. For instance, in the case where the casing comprises a motor flange removably fixed to the toroidal portion, wherein the stator is fixed with respect to the motor flange, the motor flange may comprise means, for example in the form of a groove or a hole, for guiding movement of the pin, thus enabling blocking of the second flange.

In various embodiments, the blocking system comprises an electromagnetic device configured for selectively displacing the pin into the first position or second position. For instance, in various embodiments, the electromagnetic device comprises a solenoid and a spring, wherein:

when the solenoid is supplied, the pin is displaced by means of the solenoid into the second position; and when the solenoid is not supplied, the pin is displaced by means of the spring into the first position.

The above electromagnetic devices are well known, for example, from the documents Nos. US 2017/169926 A1 or EP 2 521 155 A1.

Also in this case, the stabilising system may comprise one or more encoders configured for detecting rotation of the first flange and/or of the second flange, which makes it possible to verify whether the blocking system is active.

BRIEF DESCRIPTION OF THE DRAWINGS

The present invention will now be described in detail with reference to the attached drawings, provided purely by way of non-limiting example, and in which.

DETAILED DESCRIPTION OF EMBODIMENTS

In the ensuing description, various specific details are illustrated aimed at providing an in-depth understanding of the embodiments. The embodiments may be obtained without one or more of the specific details, or with other methods, components, materials, etc. In other cases, known structures, materials, or operations are not illustrated or described in detail so that various aspects of the embodiments will not be obscured.

Reference to "an embodiment" or "one embodiment" in the framework of this description is intended to indicate that a particular configuration, structure, or characteristic described in relation to the embodiment is comprised in at least one embodiment. Hence, phrases such as "in an embodiment" or "in one embodiment" that may be present in various points of this description do not necessarily refer to one and the same embodiment. Moreover, particular conformations, structures, or characteristics may be adequately combined in one or more embodiments.

The references used herein are provided only for convenience and hence do not define the sphere of protection or the scope of the embodiments.

First Embodiment (Prior Art)

Figure 3:
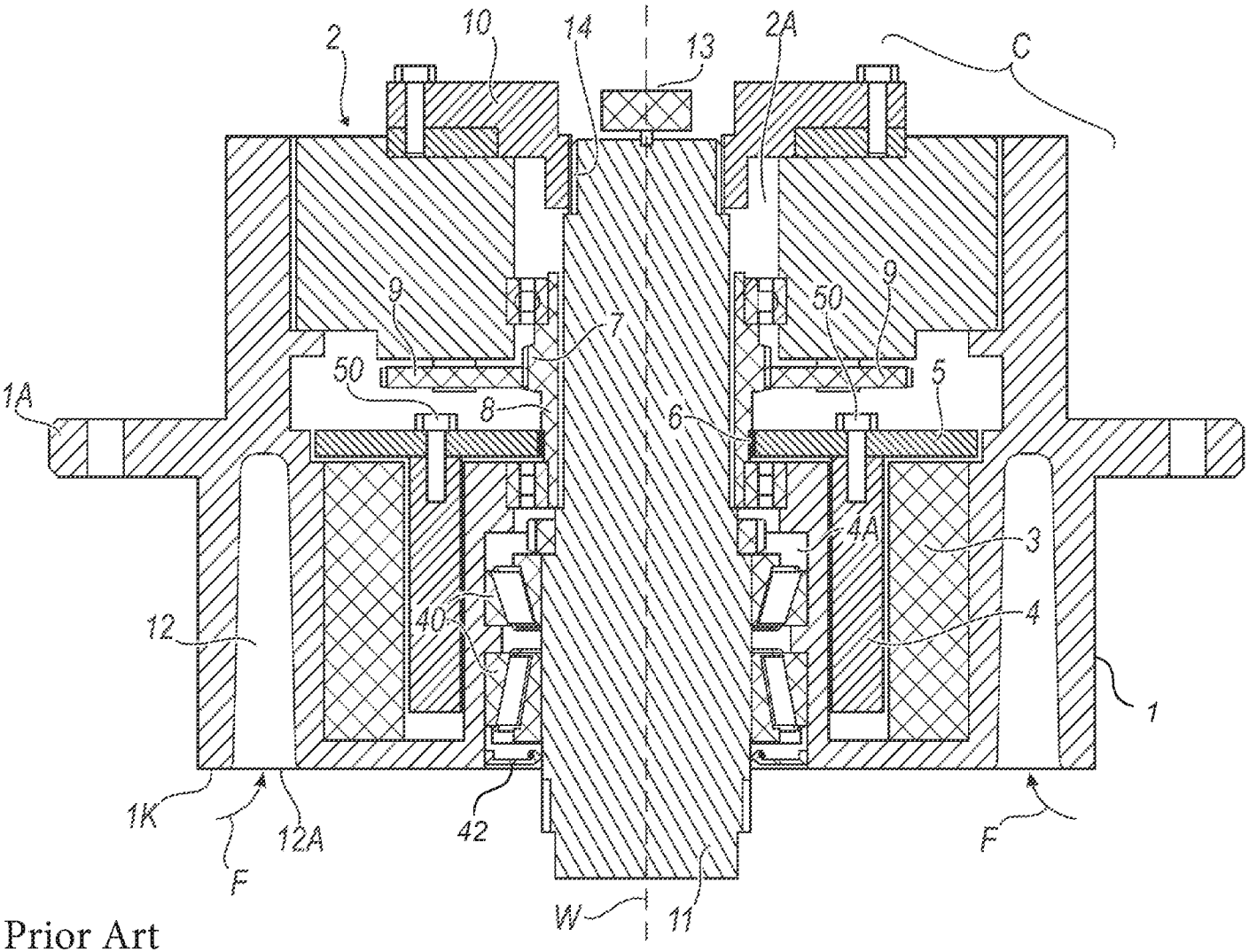
Prior Art Fig. 3
FIGS. 3 and 4 (prior art) show the cross section of a first embodiment of a driving system configured for moving a stabilising fin of a stabilising system.
Figure 4:
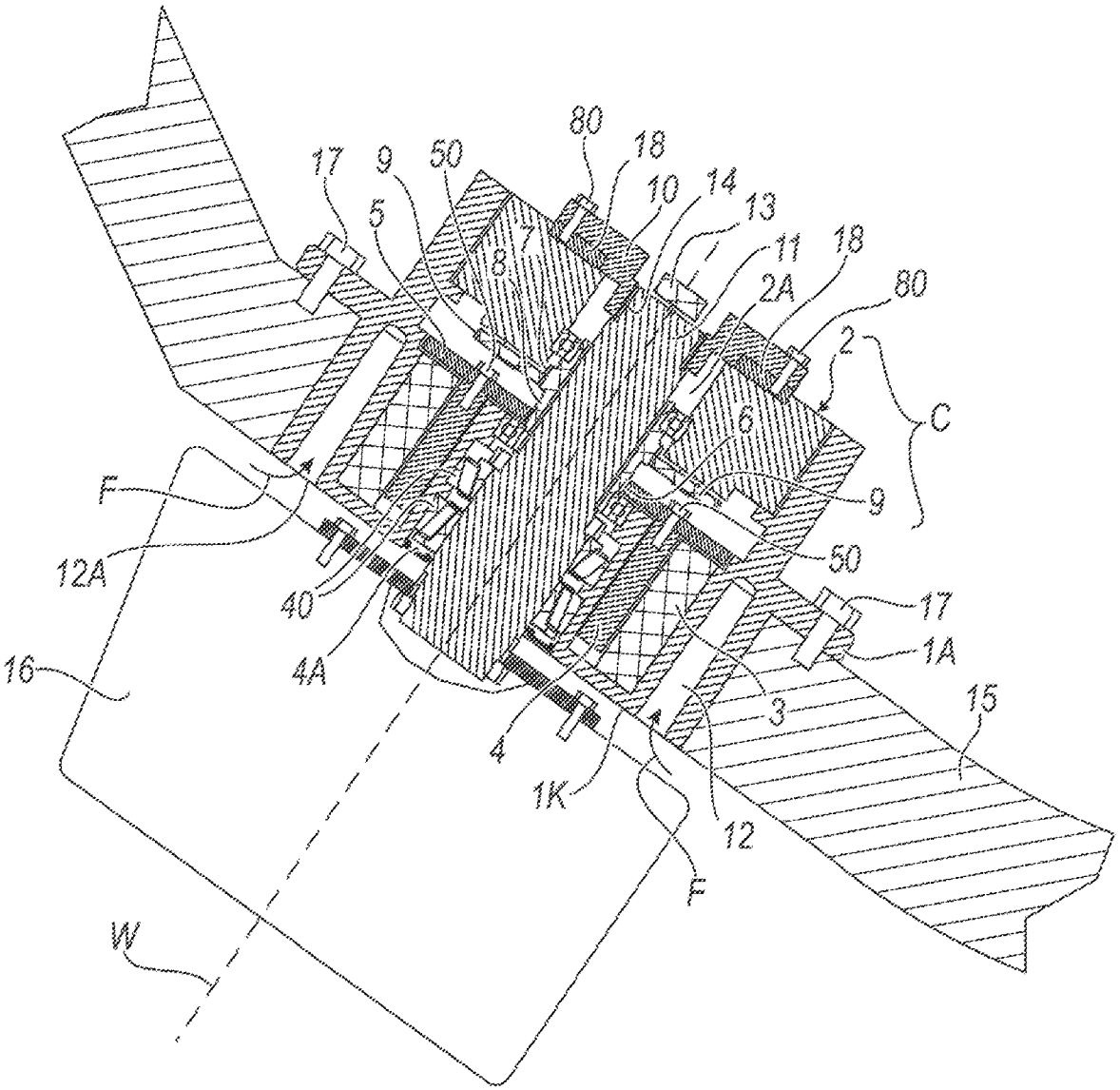
Prior Art Fig. 4

FIGS. 3 and 4 (prior art) substantially illustrate the electromechanical assembly C described in the Italian patent application No. 102016000007060 filed on Jan. 25, 2016.

Represented in the above figures is a first embodiment of an electromechanical assembly for driving a stabilising fin 16 for a watercraft, the electromechanical assembly being designated as a whole by C. In particular, the electromechanical assembly C is configured for managing the rotary motion of a shaft 11 connected, for example via a grooved profile and/or screws, to the stabilising fin 16 (see FIG. 4).

In the embodiment considered, the components of the electromechanical assembly C are housed in a housing or casing 1, which, in this way, constitutes an autonomous and complete modular unit, which can be easily installed on the desired watercraft. In particular, in the embodiment considered, the casing 1 is shaped like a bushing and comprises a cavity with a substantially cylindrical shape for receiving an electric motor and a reduction gear.

As illustrated in FIG. 4, the aforesaid bushing 1 is mounted within a (typically cylindrical) opening of the hull 15 of the watercraft, for example in a position close to the waterline so as to be able to connect the electromechanical assembly C to the stabilising fin 16. For instance, for this purpose, the bushing 1 may comprise a flange 1A, and coupling of the flange 1A to the hull 15 may be obtained via bolts or screws 17 in such a way as to render the electromechanical assembly C fixed with respect to the hull 15 of the watercraft, thus enabling stabilisation thereof through the fin 16.

In the embodiment considered, the motion and torque required by the shaft 11 of the fin 16 are transmitted via the electric motor constituted by a stator 3 and by a rotor 4, and via the reduction gear 2. To obtain an electromechanical assembly for control of the stabilising fin 16 having a vertical encumbrance that is as small as possible, it is possible to use as electric motor 3, 4 a torque motor that enables generation of high torques, useful for driving a stabilising fin 16. The reduction gear 2 is hence able to increase the torque supplied by the torque electric motor 3, 4, at the same time reducing the angular velocity of the latter.

In particular, in the embodiment considered, the stator 3 of the electric motor is fixed to the bushing 1. Consequently, when the motor is driven, the rotor part 4 of the motor turns with respect to the stator 3, i.e., with respect to the bushing 1. The rotor part 4 is connected to the input of the reduction gear 2 and the output of the reduction gear 2 is fixed to the shaft 11 of the fin.

For instance, in the embodiment considered, the rotor 4 is fixed, for example via screws 50, with respect to a flange 5, through which rotation of the rotor 4 is transferred on the outside of the motor. This motion is then transferred to the input of the reduction gear 2. For instance, in various embodiments, through a mechanical coupling, for example, a grooved profile 6 or by means of interference fit, the flange 5 drives in rotation a sun pinion 8, which is directly or indirectly connected to the input of the reduction gear 2. For instance, in the embodiment considered, the sun pinion 8 engages, via teeth 7, with planetary gears 9, thus transmitting motion to the input of the reduction gear 2.

In the embodiment considered, the motion output of the reduction gear 2, which will reduce the motion, occurs via a rotary flange 10. In particular, in the embodiment considered, the flange 10 is fixed, for example via screws 80, to the output 18 of the reduction gear 2, and the flange 10 transmits the motion, for example by means of mechanical coupling, for instance through a grooved profile 14, to the shaft 11 of the fin 15. For example, the reduction gear 2 may be a reduction gear of a cycloid type, which, as described previously, can be coupled to the motor optionally by means of a set of planetary gears.

In particular, in the embodiment considered, the rotor 4 and the reduction gear 2 (and likewise the flange 5 and the flange 10) are configured for turning in parallel planes that are perpendicular to the axis W of the shaft 11. Moreover, in the embodiment considered, the rotor 4 and the reduction gear 2 (and likewise the flange 5 and the flange 10) are arranged coaxially.

Moreover, in the embodiment considered, the reduction gear 2 and the motor 3, 4 have a hollow shaft; namely, the reduction gear 2 delimits a corresponding internal cavity 2A and the motor 3, 4 delimits a corresponding internal cavity 4A. In particular, in the embodiment considered, the cavities 2A and 4A are coaxial and arranged one after the other within the bushing 1. Consequently, in the embodiment considered, the two main components of the electromechanical assembly C, i.e., the motor and the reduction gear 2, are mounted in a coaxial way so that the cavities 2A and 4A delimited thereby (referred to above) enable the shaft 11 of the fin to pass freely through them. Likewise, also the flange 5 comprises a central opening, and the sun pinion 8 (if present) is hollow in such a way as to enable passage of the shaft 11.

In particular, in the embodiment considered, the reduction gear 2 is mounted above the electric motor, with reference to the fin 16, which is, instead, mounted underneath said motor. In this way, the shaft 11 can be housed within the motor and the reduction gear.

In various embodiments, the space between the shaft 11 and the reduction gear 2 and/or the motor 3, 4 may be used for housing bearings 40 for supporting the shaft 11 of the fin 16. For instance, in the embodiment considered, the assembly C comprises in the cavity 4A (between the motor and the shaft 11) a plurality of bearings 40 arranged radially with respect to the axis W of the shaft 11, such as bearings with conical rollers.

A considerable drawback of a torque motor is the need for a cooling system that enables the motor itself to remain at the temperatures necessary to prevent degradation of the torque supplied. For this purpose, in the prior art these motors are cooled by systems with circulation of water cooled by heat exchangers with refrigerating cycles.

Instead, in the embodiment described previously, this drawback is solved thanks to installation of the housing or bushing 1 in an opening of the hull 15 in such a way that a free end 1K of the bushing 1, i.e., the bottom portion of the housing or bushing 1 that comprises the motor 3, 4, is in contact with the water adjacent to the hull 15 of the watercraft (see FIG. 4). For this reason, the bearings 40 are preferably protected from water by means of one or more gaskets 42 that closes/close the space between the shaft 11 of the fin and the internal part of the rotor 4, i.e., the cavity 4A of the motor (FIG. 3).

Cooling of the motor 3, 4 can be improved further by enabling the water adjacent to the hull 15 of the watercraft (FIG. 4) to circulate freely in an annular cavity 12 (either continuous or defined by adjacent and discrete sections, which as a whole define the aforesaid cavity) provided in the bushing 1 for containing the mechanical part so as to cool the electric motor constantly and in an automatic way. The annular cavity 12 has at least one opening 12A below the waterline of the watercraft. This opening is arranged at the free end 1K of the bushing 1. The aforesaid annular cavity 12 is arranged around at least the motor 3, 4 so as to enable cooling thereof via the water (for example, sea water) without any need to provide circuits or mechanical members specifically designed for the aforesaid cooling function. The arrows F of FIGS. 3 and 4 show the inlet of water into the cavity 12.

The above cooling thus occurs in a "natural" way thanks to circulation (if the watercraft is moving) or in any case to the presence (if the watercraft is at anchor) in the cavity 12 of the water on which the watercraft floats and is partially immersed.

This solution is easily allowed by the fact that the reduction gear 2 is positioned above the electric motor 3,4 (with respect to the position of the fin 16).

Figure 1:
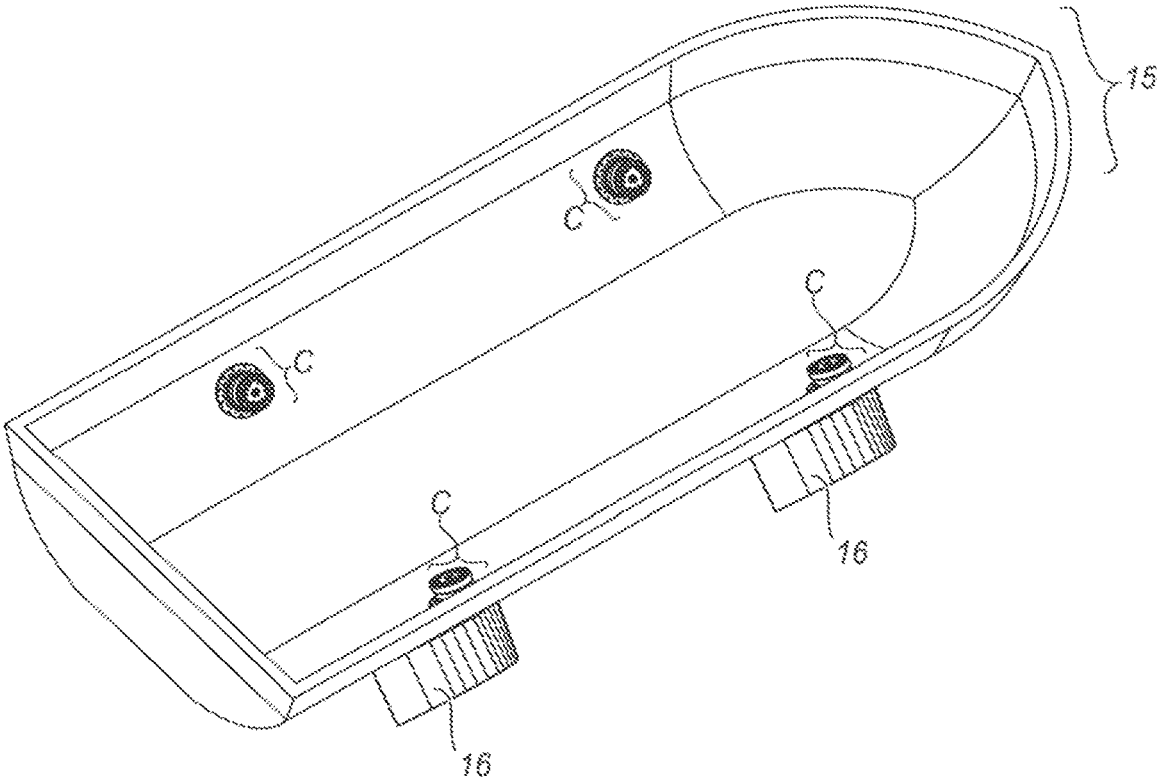
Prior Art Fig. 1
FIGS. 1 and 2 (prior art) have already been described.
Figure 2:
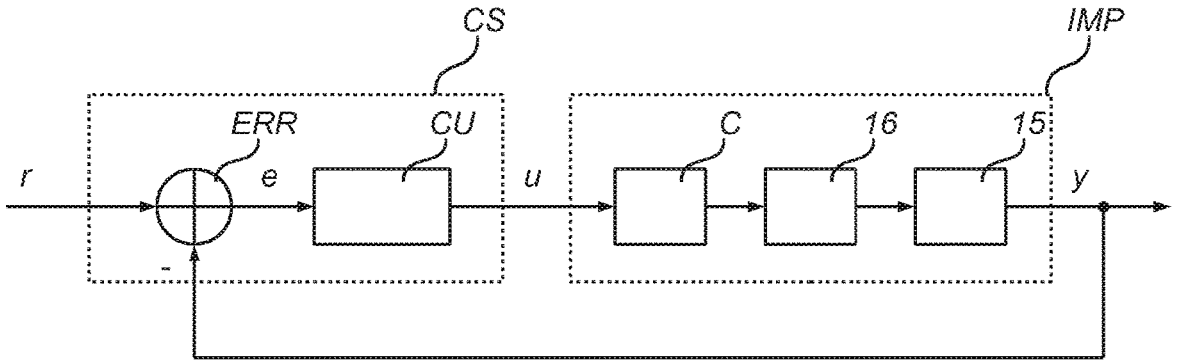
Prior Art Fig. 2

As explained previously, the aforesaid electromechanical assembly C that drives the fin 15, in particular the electric motor 3,4 is typically driven via a control system CS (see FIG. 2) in such a way as to stabilise roll of the watercraft during navigation, but also when the watercraft is at anchor.

For instance, in the embodiment considered, there may be envisaged use of a detector or sensor 13 for detecting the position of the shaft 11 of the fin 16. Typically, this detector 13 is also connected to the control system CS that drives the motor 3, 4. In particular, in the embodiment considered, the detector 13 is preferably positioned at the end of the shaft 11 of the fin engaged in the flange 10. This is allowed by the fact that the electric motor and the reduction gear 2 have hollow shafts, and the shaft 11 can thus freely be passed through them as far as the flange 10 that generates motion thereof. This enables the shaft to be coupled to the detector 13, and in this way there is direct detection of rotation of the shaft 11 itself insofar as the detector 13 is directly connected to the shaft 11.

The embodiments discussed previously thus enable provision of a modular assembly including a minimal number of components, i.e., an electric motor 3, 4 mounted in a coaxial way to a reduction gear 2, both of which are hollow and contain the shaft 11 of the fin 16, wherein the reduction gear 2 is advantageously mounted above the electric motor. Consequently, as has been said, the shaft 11 of the fin 16 traverses the entire electromechanical assembly C so as to enable direct installation of the sensor 13 for detecting the position of the shaft 11 of the fin.

Moreover, the solution described enables cooling of the electric motor in a natural way via contact with the water adjacent to the hull of the watercraft, at the same time obtaining a drastic reduction of the axial encumbrance of the electromechanical assembly to the advantage of the greater space available in the areas underneath, provided for housing passengers.

Second Embodiment

FIGS. 5 to 12 show various aspects of a second embodiment of the assembly C.

Also in this case, the casing 1 is shaped substantially like a bushing with a mounting flange 1A in such a way that the assembly C can be mounted in an opening of the hull 15 (see FIG. 4). Again arranged within the bushing 1 are a motor (with stator 3 and rotor 4), such as a torque motor, and a reduction gear 2, such as a cycloid reduction gear.

In particular, also in this case, the motor and the reduction gear 2 have a hollow shaft and are arranged coaxially. For this purpose, the rotor 4 is connected to the input of the reduction gear 2 through a flange 5. For instance, in the embodiment considered, the flange 5 (with central opening) transmits the motion of the rotor 4 to the input of the reduction gear 2 directly through a (hollow) sun pinion 8.

Consequently, also in this case, the output of the reduction gear 2 is connected, for example, by means of a flange 10, to the shaft 11, and the shaft 11 traverses the central opening of the reduction gear 2 and of the motor 3, 4 (and likewise the flange 5 and the sun pinion 8). Consequently, the corresponding description of FIGS. 3 and 4 applies entirely also to the present embodiments.

However, in this embodiment some modifications have been made that improve operation of the assembly C.

Casing

Figure 6:
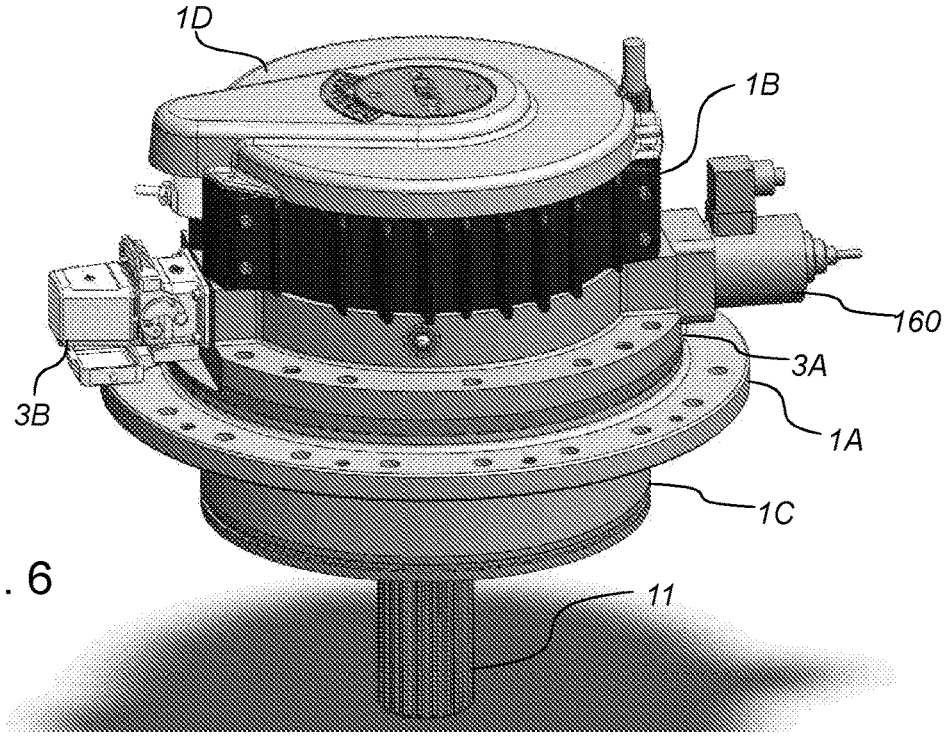
FIG. 6 shows a perspective view of the driving system of FIG. 5.
Figure 7:
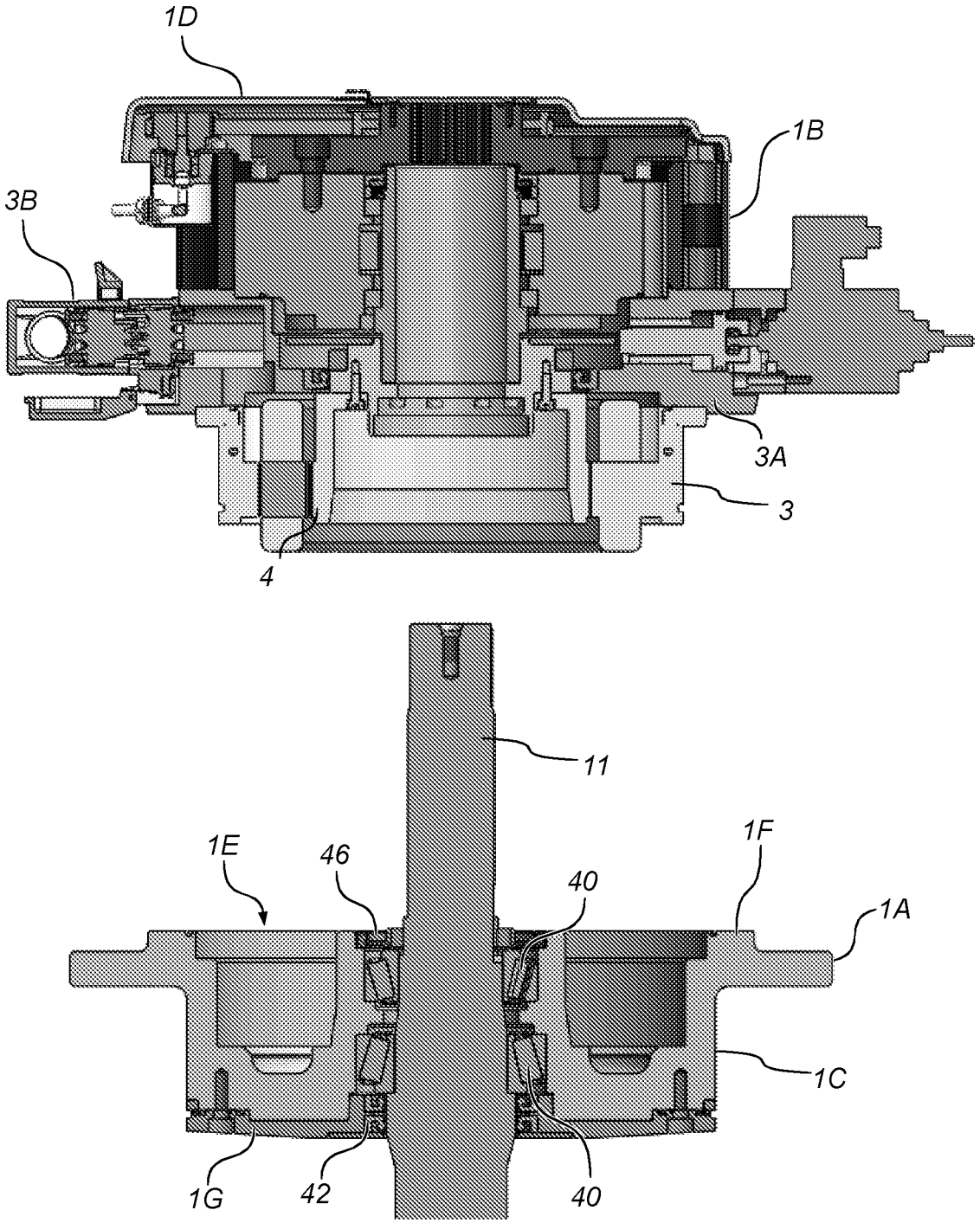
FIG. 7 shows an embodiment of installation of the driving system of FIG. 5.

Whereas the solution described with reference to FIGS. 3 and 4 comprised a single body for the casing 1, FIGS. 6 and 7 show that the casing 1 may also comprise a plurality of distinct elements.

In particular, in the embodiment considered, the casing 1 comprises a first part 1C, which once again includes a body substantially shaped like a bushing, i.e., a cylindrical body that comprises a cavity 1E closed on one side (bottom side, i.e., the side mounted towards the water) and opened on the opposite side (i.e., the top side). In the embodiment considered, this part 1C also comprises the flange 1A for fixing to the hull 15 of the watercraft.

In various embodiments, the cavity 1E has an annular shape in such a way as to form the cavity for passage of the shaft 11. Consequently, in the embodiment considered, the part 1C has a toroidal shape that is open on one side (i.e., the top side).

In this way, also the bearings 40 can be arranged between the inner wall of the part 1C and the shaft 11. In various embodiments, the shaft 11 is blocked in the body 1C, for example via coupling by interference fit with the bearings 40; i.e., the shaft 11 can be turned about the axis W with respect to the body 1C, but the shaft 11 cannot be displaced in its longitudinal direction. In various embodiments, one or more gaskets 42 and/or 46 may be provided that cover the bearings 40 on the bottom part (towards the water) and/or the top part, respectively.

In the embodiment considered, the casing 1 also comprises a second part 3A, in the form of a flange. As may be seen in the top part of FIG. 7, the stator 3 of the electric motor is fixed to the bottom part of the body 3B (i.e., the side towards the part 1C), for example by means of screws. The flange 3 may also comprise a connector 3B for electrical connection of the stator 3 to the control system CS.

Next, the flange 5 is fixed to the rotor 4 (for example, by means of screws 50), and the sun pinion 8 is connected to the flange 5. Consequently, by inserting the reduction gear 2 (possibly, with the additional planetary gears 9 described with reference to FIG. 3) on the sun pinion 8, the rotor 4 can turn also the input of the reduction gear 2. Before or after insertion of the reduction gear 2, the flange 10 can be fixed to the output of the reduction gear 2, for example by means of screws 80.

Figure 5:
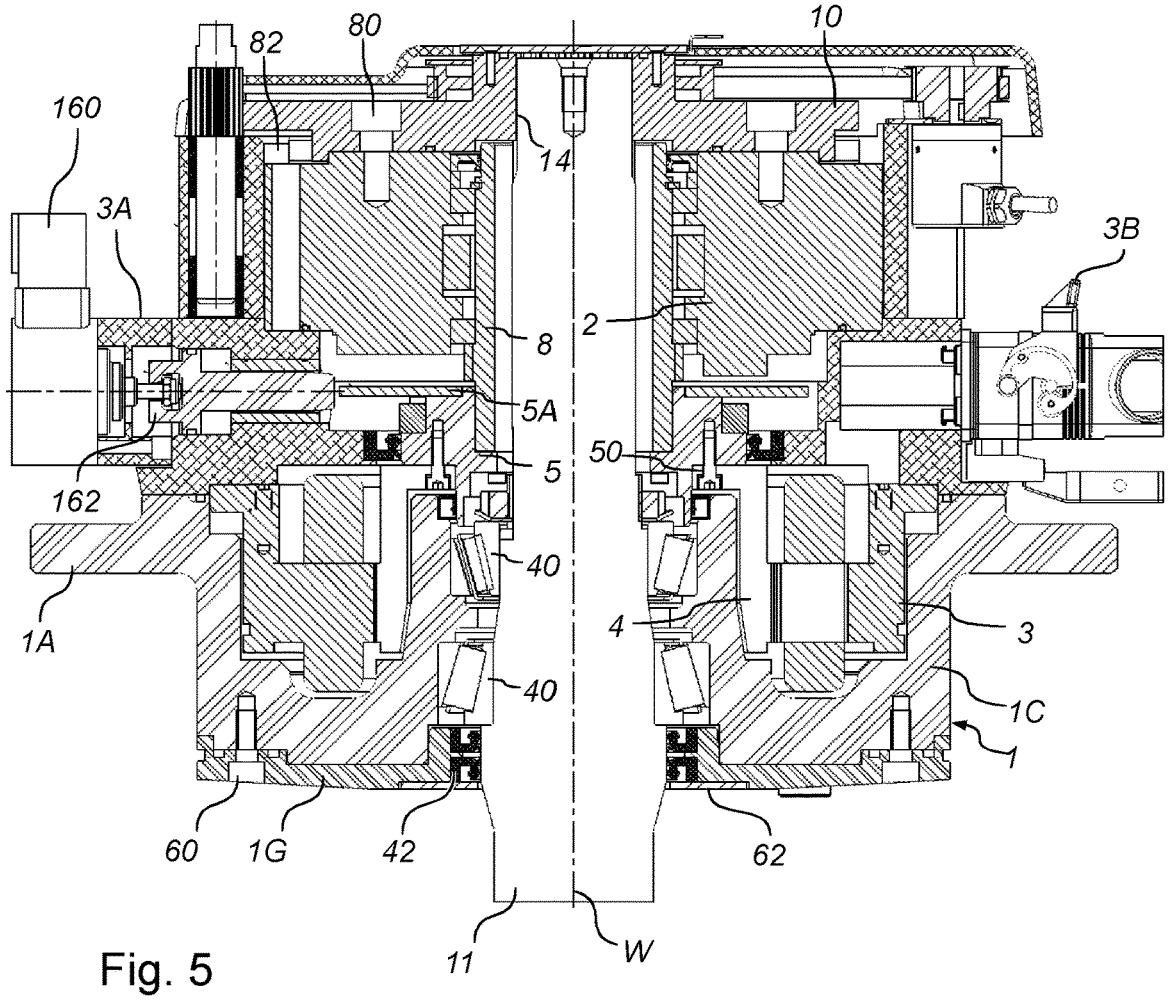
FIG. 5 shows the cross section of a second embodiment of a system for driving a stabilising system.

In various embodiments, the outer body of the reduction gear 2 may also be fixed to the body 3A, for example by means of screws 82 (see FIG. 5).

In various embodiments, there may also be provided a body 1B with a substantially cylindrical/tubular shape that encloses the reduction gear 2. This body 1B could also correspond directly to the outer casing of the reduction gear 2.

As illustrated in FIG. 6, the part 1B may also comprise on the outside additional heat dissipaters in the form of fins. Moreover, once again with reference to FIG. 6 (see also FIG. 10A that will be described hereinafter), the tubular body 1B may be obtained also with two or more half-shells.

In various embodiments, the body 1B ca may be closed on the top side by means of a cover 1D, for example by screwing the cover 1D to the body 1B.

Consequently, for the embodiment considered, the top part of FIG. 7 (actuation assembly) shows the actuation system, which comprises the reduction gear 2 and the motor 3, 4 that are fixed to the body 3A. Instead, the bottom part of FIG. 7 (driven assembly) shows the body 1C (with shaft 11) that is fixed to the hull of the watercraft. Consequently, by inserting the top block 1B, 3A in the bottom block 1C, the stator 3 and the rotor 4 are inserted into the cavity 1E, and the shaft 11 is connected to the flange 10. The top part is preferably fixed in a reversible/removable way to the bottom part, for example, by fixing the flange 3A of the motor to a flange 1F of the body 1C, for example by means of screws.

This fixing hence facilitates installation and maintenance of the system since the actuation assembly can be extracted from the driven assembly, whereas the driven assembly remains fixed to the hull 15, guaranteeing tightness.

Gasket

Whereas in the solution illustrated in FIGS. 3 and 4, the gasket 42 was directly fixed to the main body 1, FIGS. 5 and 7 show that, in various embodiments, the gasket or gaskets 42 can be fixed to an additional cover 1G. In particular, the aforesaid cover 1G has a substantially annular shape with a central hole for passage of the shaft 11. In the central hole there are then arranged one or more gaskets 42, also these with a substantially annular shape. Consequently, in various embodiments, the aforesaid cover 1G can be fixed to the bottom/outer wall of the body 1C (i.e., the side towards the water), for example by means of screws 60.

Consequently, in this way, the gasket or gaskets 42 can be replaced more easily. Moreover, the cover 1G may be made of a material that is more resistant to water, in particular to sea water. For instance, in various embodiments, the cover 1G is made of stainless steel, or other stainless alloys/steels, i.e., ones resistant to corrosion.

As illustrated in FIG. 5, in various embodiments the cover 1G may also comprise an annular groove on the outer side, in which an additional cover 62 (with complementary annular shape) can be inserted. The cover 62 can be fixed to the cover 1G also by means of screws. Consequently, the ring 62 protects the gasket or gaskets 42 since it prevents intrusion of material (ropes, fishing lines, molluscs, etc.) that might damage the gasket or gaskets 42. Alternatively or in addition, an elastic ring could also be used, fitted on the shaft 11.

Encoder for Detecting the Position of the Shaft of the Fin

In the embodiment described with reference to FIGS. 3 and 4, the assembly C comprised an encoder 13 configured for directly detecting rotation of the shaft 11.

Figure 8:
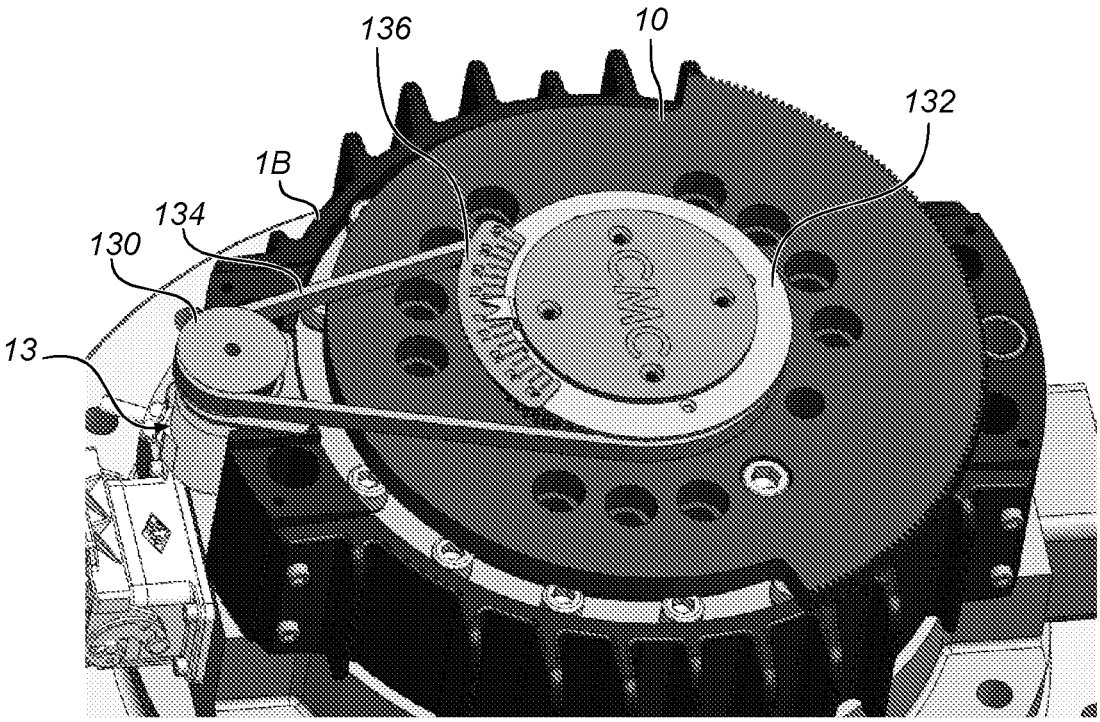
FIG. 8 shows an embodiment of an encoder configured for detecting the absolute position of the stabilising fin in the driving system of FIG. 5.

Instead, as illustrated in FIG. 8, the body of the encoder 13 may be fixed also to the casing 1, for example the body 1B described previously, or the outer body of the reduction gear 2, and the assembly C comprises means for transmitting the motion of the flange 10 (or of the shaft 11, which in any case is connected to the flange 10) to the input of the encoder 13.

For instance, in the embodiment considered, the input of the encoder 13 comprises a first pulley 130, and the flange 10 (or the shaft 11) comprises a second pulley 132. Consequently, in the embodiment considered, the first pulley 130 and the second pulley 132 may be connected via a belt 134 that transmits rotation of the flange 10 (or of the shaft 11) to the input of the encoder 13. Instead of the pulleys 130 and 132, also other transmission means may be used, for example gears.

Consequently, in the embodiment considered, the encoder 13 does not increase the height of the assembly C since the encoder 13 can be arranged laterally.

In various embodiments, the encoder 13 is an absolute encoder that supplies data that identify the absolute position of the shaft 11 and hence of the stabilising fin 16.

Visual Indicator

Figure 9:
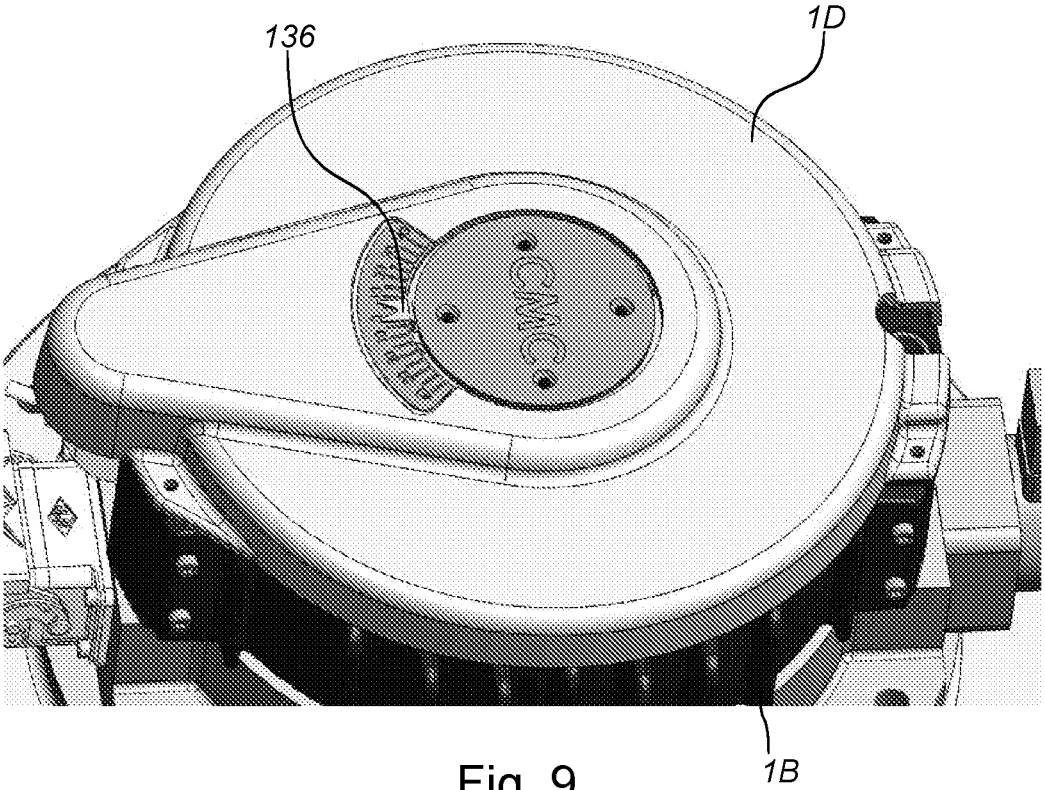
FIG. 9 shows an embodiment of a visual indicator configured for displaying the absolute position of the stabilising fin in the driving system of FIG. 5.

As illustrated in FIG. 8 and also in FIG. 9, the shaft of the fin 11 may have associated to it also a visual indicator 136 that is fixed with respect to the flange 10 (or to the pulley 132). For instance, in the embodiment considered, the aforesaid visual indicator 136 is obtained by means of a tab that is fixed to the flange 10 (or to the pulley 132), and is hence turned together with the flange 10. Consequently, the aforesaid visual indicator 136 may be configured for providing on a graduated scale immediate reading of the angle of rotation of the fin, also when the casing 1 is closed on the top part (i.e., on the side of the reduction gear 2) via the cover 1D.

In various embodiments, the graduated scale is fixed with respect to the casing 1, for example the cover 1D.

Auxiliary Rotation Mechanism

Figure 10A:
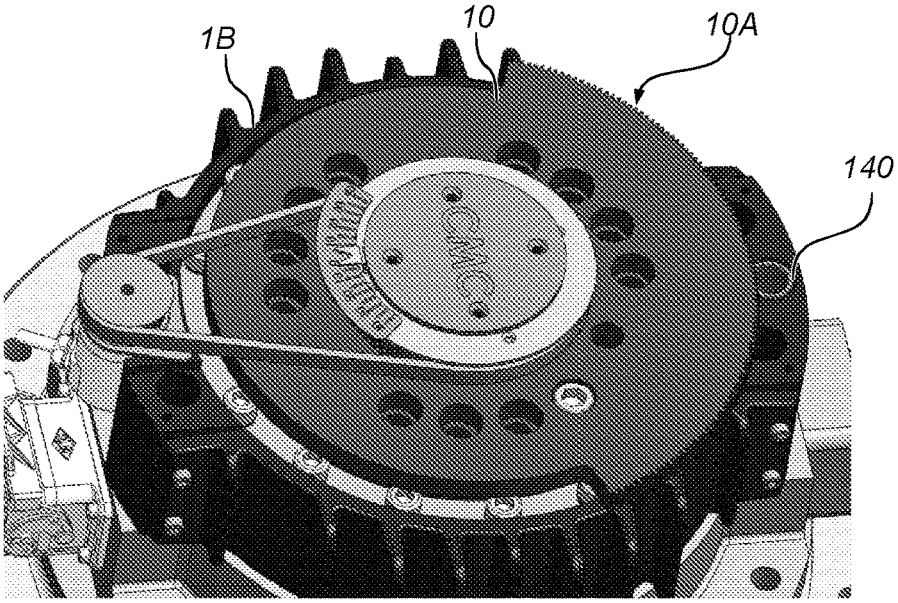
FIGS. 10A to 10C show an embodiment of an auxiliary mechanism of rotation configured for enabling manual rotation of the driving system of FIG. 5.
Figure 10B:
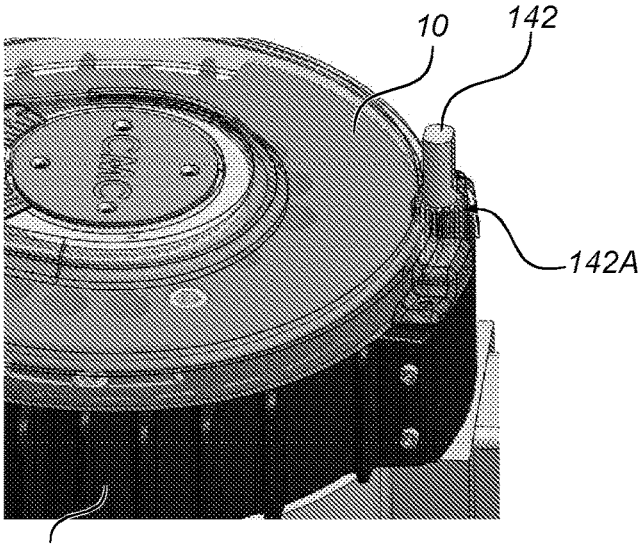
Figure 10C:
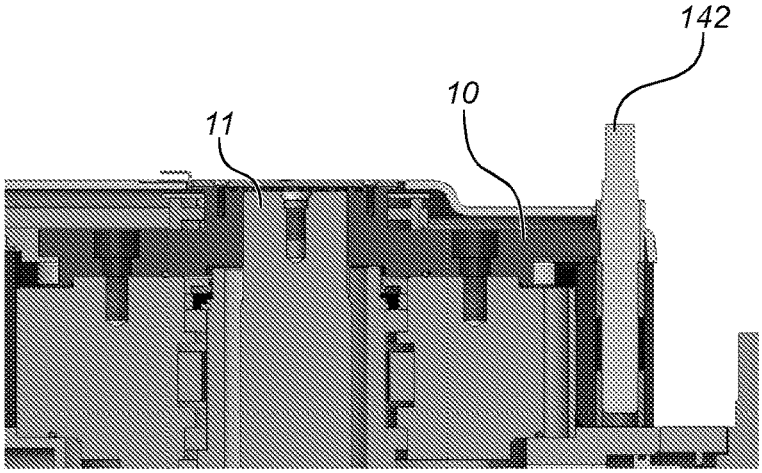

As illustrated in FIGS. 10A to 10C, the flange 10 may comprise at least partially a grooved profile 10A, thus providing a toothing.

In various embodiments, the aforesaid grooved profile 10A can be used for turning the flange 10 and hence the shaft 11 manually.

For instance, as illustrated in FIGS. 10B and 10C, the casing 1, for example the body 1B, may comprise a seat 140, for example in the form of a hole, which enables insertion of a pin 142. In particular, in the embodiment considered, the pin 142 has a toothing 142A configured for engaging with the grooved profile 10A of the flange 10 when the pin 142 is inserted into the seat 140. Consequently, by turning the pin 142, the toothing of the pin 142 works on the toothing 10A of the flange 10, which in this way is turned. For instance, the grooved profiles may be configured to provide a transmission ratio of between 1:10 and 1:20 (ratio between rotation of the flange 10 and rotation of the pin 142).

In general, the pin 142 may also be inserted always in the seat of the casing 1. Moreover, the pin 142 may also form part of a larger crank that enables turning of the pin 142 more easily.

Consequently, in the case of emergency, it is possible to insert the pin 142 into the purposely provided seat 140 that enables manual movement of the system.

Encoder for Detecting the Velocity/Acceleration of the Motor

Figure 11:
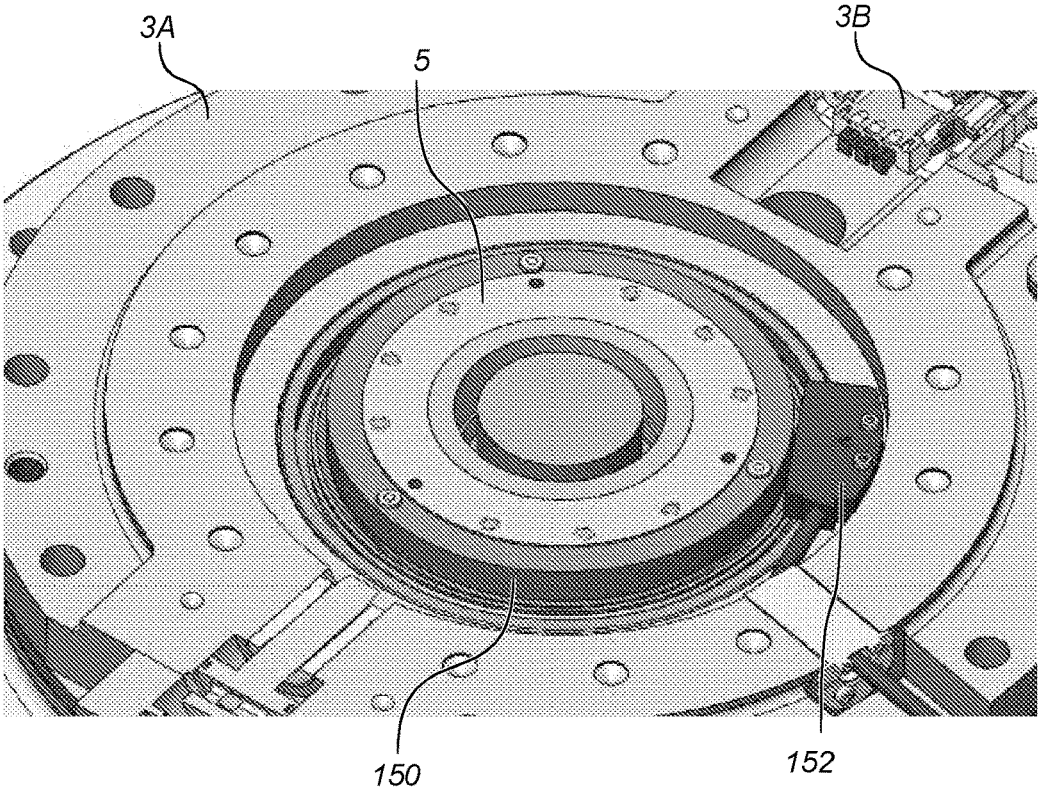
FIG. 11 shows an embodiment of an incremental encoder configured for detecting the velocity and/or acceleration of the electric motor of the driving system of FIG. 5.

FIG. 11 shows that the assembly may also comprise a second encoder configured for directly detecting rotation of the output of the motor. In particular, FIG. 11 shows a perspective view of the flange 5 that is connected to the rotor 4 of the motor. FIG. 11 also shows the flange 3A of the motor, which can be fixed to the bodies 1B and 1C (see FIG. 7), and the electrical connector 3B.

In general, as explained previously, the flange 5 is fixed with respect to the rotor 4 of the motor, for example by means of screws 50. In the embodiment considered, an additional encoder 152 may hence be configured for detecting rotation of the flange 5 in such a way as to detect rotation of the rotor 4.

For instance, in the embodiment considered, a linear encoder is used. In particular, in the embodiment considered, the encoder 152 is a magnetic linear encoder. Consequently, in the embodiment considered, a magnetic ring 150 is fitted on the flange 5, and the encoder is fixed in the internal part of the flange 3A in such a way as to detect rotation of the magnetic ring 150.

Consequently, in the embodiment considered, the encoders 150/152 directly detect rotation of the flange 5 that corresponds to rotation of the rotor 4 of the motor. Moreover, the encoder 150/152 is arranged between the electric motor and the reduction gear 2.

In general, instead of a magnetic encoder there could be used also another type of encoder that detects rotation of the flange 5, for example using pulleys (see also FIG. 10A) or gears, or else optical, inductive, capacitive encoders, etc.

Consequently, in the embodiment considered, the encoder 152 is a linear encoder configured for directly detecting rotation of the flange 5 (and hence of the electric motor), and the encoder 13 is an absolute encoder configured for directly detecting rotation of the flange 10 (and hence of the shaft 11).

Hence, whereas the encoder 13 provides information on the absolute position of the fin 16, the encoder 152 provides data on rotation of the motor, above all in terms of velocity and/or acceleration, which is useful for controlling the motor 3, 4.

Blocking System

Figure 12:
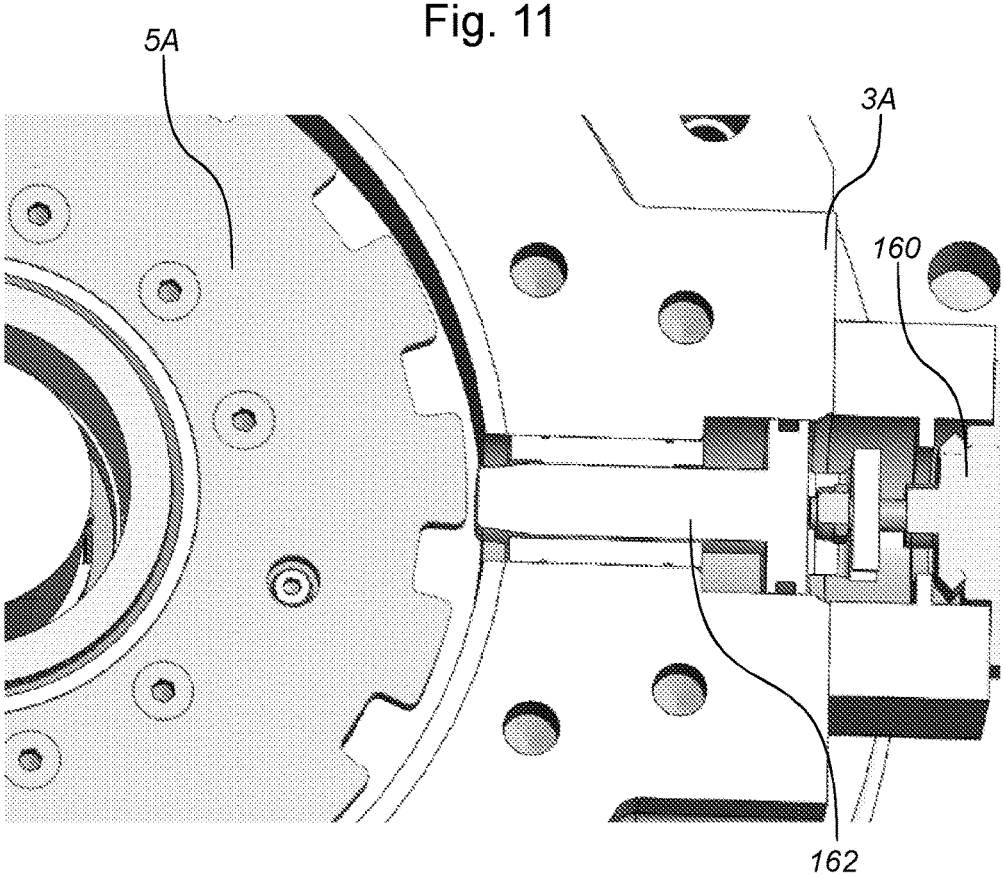
FIG. 12 shows an embodiment of an auxiliary blocking mechanism configured for inhibiting rotation of the driving system of FIG. 5.

FIG. 12 shows that the assembly may also comprise a blocking system configured for inhibiting rotation of the assembly, i.e., of the motor, of the reduction gear, and hence of the shaft 11.

In particular, FIG. 12 shows a cross-sectional view from above of the flange 3A of the motor.

In particular, in the embodiment considered, the flange 5 or, as illustrated in FIG. 12, an additional flange 5A that is fixed with respect to the flange 5 (see also FIG. 6), for example by means of screws, is shaped with a plurality of slots/cut-outs, i.e., the flange 5 or the additional flange 5A corresponds to a shaped disk (with a central hole for passage of the shaft 11), comprising a plurality of slots arranged radially.

Consequently, in the embodiment considered, a pin 162 can be inserted in one of the slots of the flange 5/5A in such a way as to block rotation of the flange 5/5A and hence of the entire mechanism. Likewise, the blocking system could also intervene on the flange 10 and not on the flange 5/5A.

For instance, in the embodiment considered, the pin 162 is displaceable in a radial direction with respect to the axis W of the shaft 11. Consequently, the pin can be housed in a groove/opening of the body 3A.

In the embodiment considered, displacement of the pin 162 is controlled by means of an electromagnetic device 160, which comprises a solenoid and preferably a spring.

In particular, in various embodiments, the electromagnetic device 160 is configured in such a way that:

when the solenoid is supplied, the pin 162 is displaced into a first position (extracted, for example compressing, in this way the spring), in which the flange 5/5A can turn; and when the solenoid is not supplied, the pin 162 is displaced into a second position (blocking, for example by means of the spring), in which the pin 162 is inserted in a slot of the flange 5/5A, thus blocking rotation.

Consequently, in various embodiments, the mechanism can be turned only when the blocking system, in particular the device 160, is supplied.

The second embodiment hence comprises a casing 1 including a toroidal portion (for example 1C) that is open on one side. This toroidal portion is configured for being inserted in a (circular) opening in the hull 15 of a watercraft. In particular, this portion comprises means 1A for fixing the casing 1 to the hull 15 of the watercraft.

Set in the casing 1 are an electric motor 3, 4 and a reduction gear 2. Both are hollow and arranged coaxially. In particular, the stator 3 of the motor is fixed with respect to the casing 1, and the rotor 4 is connected to the input of the reduction gear 2, and the output of the reduction gear 2 is connected to the shaft 11 of a stabilising fin 16. For instance, in various embodiments, the rotor 4 is connected to the input of the reduction gear 2 by means of a flange 5 and possibly a sun pinion 8, and/or the output of the reduction gear 2 is fixed with respect to a shaft 11 by means of a flange 10.

In various embodiments, the motor 3, 4 is arranged in the toroidal portion of the casing 1 that is to be inserted into the opening of the hull 15. In this way, the shaft 11 passes through the internal space of the reduction gear 2 and the internal space of the motor 34, and the motor 3, 4 is arranged between the reduction gear 2 and the stabilising fin 16. Preferably, the toroidal portion comprises for this purpose a plurality of bearings 40 arranged (radially with respect to the axis W) between the toroidal portion and the shaft 11. As explained previously, the motor 3, 4 can be driven via a control system CS as a function of the roll of the watercraft.

The various improvements described previously may hence be applied individually or in combination with the aforesaid assembly C; i.e., the assembly may comprise at least one of the following:

the modular casing described with reference to FIG. 7;

the cover 1G that carries the gasket or gaskets 42 described with reference to FIGS. 5 and 7;

the encoder for detecting the absolute position of the shaft 11 and possibly the visual indicator described with reference to FIGS. 8 and 9;

the auxiliary mechanism of rotation described with reference to FIGS. 10A to 10C;

the encoder for detecting the velocity and/or acceleration of the rotor 4 of the motor described with reference to FIG. 11; and the blocking system described with reference to FIG. 12.

Of course, without prejudice to the principle of the invention, the details of construction and the embodiments may vary widely with respect to what has been described and illustrated herein purely by way of example, without thereby departing from the scope of the present invention, as defined by the ensuing claims. For instance, in particular, use of the electromechanical assembly for governing and controlling a corresponding stabilising fin has been described. However, this electromechanical assembly may be associated to any appendage for controlling a watercraft, such as the rudder.

The invention claimed is:

1. Stabilization system for a watercraft with a hull, comprising:

a stabilization fin rigidly connected to a shaft of the fin;

an actuator system comprising:

a) a housing comprising a toroidal portion configured to be inserted in an opening of said hull, wherein the toroidal portion comprises means for fixing the housing to said hull, b) a reduction gear with hollow shaft, wherein said reduction gear comprises an external body, an output connected to said shaft of the fin and an input, and c) an electric motor with hollow shaft, wherein said electric motor is arranged in said toroidal portion and comprises a stator rigidly connected to said housing and a rotor connected to said input of said reduction gear, wherein said shaft of the fin passes through said electric motor and said reduction gear, and said electric motor is arranged between said reduction gear and said stabilization fin; and a control system configured to receive data identifying the roll of said watercraft and drive said electric motor a function of said roll;

wherein said housing comprises:

a motor flange fixed in removeable manner to said toroidal portion, wherein said stator is fixed from a first side to said motor flange and said external body of said reduction gear is fixed from the opposite side to said motor flange, a first cover fixed in removeable manner to the external side of said toroidal portion oriented towards said stabilization fin, wherein said first cover comprises at least one gasket for sealing the opening between said toroidal portion and said shaft of the fin, and wherein said first cover is in stainless steel, or another water-resistant material, in particular concerning sea water.

2. Stabilization system according to claim 1, wherein said housing comprises:

a tubular portion fixed to said motor flange, wherein said reduction gear is arranged in said tubular portion, wherein said tubular portion comprises wings implementing a heat sink.

3. Stabilization system according to claim 1, wherein said housing comprises:

a second cover fixed to said external body of said reduction gear and/or a tubular portion in order to cover said reduction gear.

4. Stabilization system according to claim 1, wherein said rotor is connected to said input of said reduction gear via a first flange with central opening and a hollow sun pinion, wherein said first flange with central opening is rigidly connected to said rotor via screws, and said hollow sun pinion is connected to said first flange with central opening), and wherein said hollow sun pinion engages indirectly via additional planetary gears or directly with said input of said reduction gear.

5. Stabilization system according to claim 4, comprising a blocking system fixed to said motor flange and configured to selectively inhibit the rotation of said first flange with central opening.

6. Stabilization system according to claim 1, wherein said output of said reduction gear is connected to said shaft of the fin via a second flange, wherein said second flange is rigidly connected to said output of said reduction gear via screws, and wherein said second flange is connected via a mechanical coupling to said shaft of the fin.

7. Stabilization system according to claim 1, wherein a plurality of bearings is arranged radially with respect to the axis of said shaft of the fin between said toroidal portion and said shaft of the fin.

8. Stabilization system according to claim 1, wherein said motor flange comprises a connector for receiving the drive signals for the stator of said electric motor.

9. Stabilization system for a watercraft with a hull, comprising:

a stabilization fin rigidly connected to a shaft of the fin;

an actuator system comprising:

a) a housing comprising a toroidal portion configured to be inserted in an opening of said hull, wherein the toroidal portion comprises means for fixing the housing to said hull, b) a reduction gear with hollow shaft, wherein said reduction gear comprises an output connected via a flange to said shaft of the fin and an input, and c) an electric motor with hollow shaft, wherein said electric motor is arranged in said toroidal portion and comprises a stator rigidly connected to said housing and a rotor connected to said input of said reduction gear, wherein said shaft of the fin passes through said electric motor and said reduction gear, and said electric motor is arranged between said reduction gear and said stabilization fin; and a control system configured to receive data identifying the roll of said watercraft and drive said electric motor as a function of said roll;

wherein said stabilization system comprises an absolute encoder, wherein the body of said absolute encoder is rigidly connected to said housing and the input of said absolute encoder is coupled via transmission means to said flange, and wherein said flange has a contoured form comprising a plurality of recesses, or said flange has a further flange rigidly connected to said flange, wherein said further flange has a contoured form comprising a plurality of recesses.

10. Stabilization system according to claim 9, wherein said transmission means comprise:

a first pully rigidly connected to said input of said absolute encoder and a second pully rigidly connected to said flange, wherein said first pully is connected to said second pully via a belt; or at least one first gear rigidly connected to said input of said absolute encoder and a second gear rigidly connected to said flange.

11. Stabilization system according to claim 9, comprising a visual indicator in the form of a nib, which is rigidly connected to said flange, and a graduated scale, in order to report the rotation angle of said flange and thus of said shaft of the fin.

12. Stabilization system according to claim 9, wherein said flange has at least partially a contoured profile, wherein the stabilization system comprises a toothed rod, and wherein the stabilization system is configured such that a rotation of said rod rotates also said flange.

13. Stabilization system according to claim 12, wherein said housing comprises a seat wherein said rod may be inserted.

14. Stabilization system according to claim 9, wherein said reduction gear comprises an external body and said housing comprises:

a motor flange fixed in removeable manner to said toroidal portion, wherein said stator is fixed from a first side to said motor flange and said external body of said reduction gear is fixed from the opposite side to said motor flange; and optionally a tubular portion fixed to said motor flange, wherein said reduction gear is arranged in said tubular portion, wherein said absolute encoder is rigidly connected to said external body of said reduction gear or said tubular portion.

15. Stabilization system according to claim 9, wherein said rotor is connected to said input of said reduction gear, via a further flange with central opening and a hollow sun pinion, wherein said further flange with central opening is rigidly connected to said rotor via screws, and said hollow sun pinion is rigidly connected to said further flange with central opening, and wherein said hollow sun pinion engages indirectly via additional planetary gears or directly with said input of said reduction gear.

16. Stabilization system according to claim 15, comprising an incremental encoder, wherein the body of said incremental encoder is rigidly connected to said housing, wherein said incremental encoder is configured to detect the rotation velocity and/or acceleration of said further flange with central opening.

17. Stabilization system according to claim 16, wherein a magnetic ring is fixed to said further flange, and said incremental encoder is a magnetic encoder configured to detect the rotation of said magnetic ring.

18. Stabilization system according to claim 16, wherein said absolute encoder and said incremental encoder are connected to said control system, wherein said control system is configured to drive said electric motor as a function the data provided by said absolute encoder and said incremental encoder.

19. Stabilization system for a watercraft with a hull, comprising:

a stabilization fin rigidly connected to a shaft of the fin;

an actuator system comprising:

a) a housing comprising a toroidal portion configured to be inserted in an opening of said hull, wherein the toroidal portion comprises means for fixing the housing to said hull, b) a reduction gear with hollow shaft, wherein said reduction gear comprises an output connected via a first flange to said shaft of the fin and an input, and c) an electric motor with hollow shaft, wherein said electric motor is arranged in said toroidal portion and comprises a stator rigidly connected to said housing and a rotor connected via a second flange with central opening to said input of said reduction gear, wherein said shaft of the fin passes through said electric motor, said second flange with central opening and said reduction gear, and said electric motor is arranged between said reduction gear and said stabilization fin; and a control system configured to receive data identifying the roll of said watercraft and drive said electric motor as a function of said roll;

wherein said stabilization system comprises a blocking system configured to selectively block the rotation of said first flange or said second flange, and wherein:

said first flange or said second flange has a contoured form comprising a plurality of recesses, or a further flange is rigidly connected to said first flange or said second flange, wherein said further flange has a contoured form comprising a plurality of recesses.

20. Stabilization system according to claim 19, wherein said blocking system comprises a piston movable such that:

in a first position, the piston engages one of said recesses and blocks the rotation of said first flange or said second flange; and in a second position, the piston does not engage any of said recesses and said first flange or said second flange may rotate.

21. Stabilization system according to claim 20, wherein said blocking system comprises a electromechanical device configured to selectively move said piston in said first or said second position.

22. Stabilization system according to claim 21, wherein said electromechanical device comprises a solenoid and a spring, wherein:

when the solenoid is powered, said piston is moved via said solenoid in said second position, and when the solenoid is not powered, said piston is moved via said spring in said first position.

23. Stabilization system according to claim 20, wherein said blocking system is configured such that said piston is movable in radial direction with respect to the axis of said shaft of the fin.

24. Stabilization system according to claim 23, wherein said housing comprises:

a motor flange fixed in removeable manner to said toroidal portion, wherein said stator is rigidly connected to said motor flange, wherein said motor flange comprises means in the form of a channel or hole, for guiding the movement of said piston.

25. Stabilization system according to claim 24, comprising an incremental encoder, wherein the body of said incremental encoder is rigidly connected to said housing, wherein said incremental encoder is configured to detect the rotation velocity and/or acceleration of said second flange.

26. Stabilization system of a watercraft with a hull, comprising:

a stabilization fin rigidly connected to a shaft of the fin;

an actuator system comprising:

a) a housing comprising a toroidal portion configured to be inserted in an opening of said hull, wherein the toroidal portion comprises means for fixing the housing to said hull, b) a reduction gear with hollow shaft, wherein said reduction gear comprises an output connected to said shaft of the fin and an input, and c) an electric motor with hollow shaft, wherein said electric motor is arranged in said toroidal portion and comprises a stator rigidly connected to said housing and a rotor connected to said input of said reduction gear, wherein said shaft of the fin passes through said electric motor and said reduction gear, and said electric motor is arranged between said reduction gear and said stabilization fin; and a control system configured to receive data identifying the roll of said watercraft and drive said electric motor as a function of said roll;

wherein said actuator system comprises at least one of:

a blocking system configured to selectively block the rotation of said actuator system;

a modular housing comprising in addition to said toroidal portion at least one motor flange fixed in removeable manner to said toroidal portion, wherein said stator is fixed from a first side to said motor flange and the external body of said reduction gear is fixed from the opposite side to said motor flange, a cover fixed in removeable manner to the external side of said toroidal portion oriented towards said stabilization fin, wherein said cover comprises at least one gasket for sealing the opening between said toroidal portion and said shaft of the fin;

an absolute encoder for detecting the position of said shaft of the fin;

a visual indicator coupled a said shaft of the fin in the form of a nib, and a graduated scale, in order to report the rotation angle said shaft of the fin;

an auxiliary rotation mechanism; and an incremental encoder configured to detect the rotation velocity and/or acceleration of said rotor.

* * * * *